United States Patent [19]

Bader et al.

[11] 4,074,725

[45] Feb. 21, 1978

[54] COVER FOR A WEAVING MACHINE

[75] Inventors: Hartmann Bader, Winterthur; Ulrich Bolleter, Seuzach, both of Switzerland

[73] Assignee: Sulzer Brothers, Ltd., Winterthur, Switzerland

[21] Appl. No.: 692,277

[22] Filed: June 3, 1976

[30] Foreign Application Priority Data

June 5, 1975 Switzerland ..... 7236/75

[51] Int. Cl.[2] ..... D03D 49/00; D03J 1/00

[52] U.S. Cl. ..... 139/1 R; 181/200

[58] Field of Search ..... 139/1 R, 1 C, 193; 28/22, 33; 66/168; 98/115 R, 115; 181/33 G, 33 GB

[56] References Cited

U.S. PATENT DOCUMENTS

| | | | |
|---|---|---|---|
| 2,480,645 | 8/1949 | Gourlay | 139/193 |
| 2,491,092 | 12/1949 | Denney | 139/1 C |
| 3,378,998 | 4/1968 | Shackerford | 139/1 C |
| 3,627,201 | 12/1971 | Partsch | 139/1 C |
| 3,633,706 | 1/1972 | Kennedy | 139/1 R |
| 3,692,065 | 9/1972 | Saul | 139/1 C |
| 3,880,196 | 4/1975 | Budzyna | 139/1 R |

*Primary Examiner*—James Kee Chi

[57] ABSTRACT

A cover is located over the noisiest part of the weaving machine, i.e. the shafts of the shedding mechanism and the reed and extends, at most, to the breast beam at the cloth and of the weaving machine. The cover is made of hinged members or of a flexible sheet so as to be folded out of the way when access to the shafts or reed is required.

9 Claims, 7 Drawing Figures

COVER FOR A WEAVING MACHINE

As is known, weaving machines can be provided with hoods in order to reduce noise or provide protection against accidents. In some instances, a hood is used to cover the entire weaving machine. For example, as described in Austrian Pat. No. 287,250 a hood of this type which is used particularly for sound insulation can be lifted from a weaving machine by means of a crane or the like. In other cases, such as described in German Auslegeschrift 2,346,869, the long front of a textile machine can be covered by discrete vertical covering walls which can be coiled on reels as a means of reducing noise.

However, the covers heretofore used on these machines have generally been relatively complicated. In particular, parts or sub-units of the machine are covered to which ready access is required and which produce little, if any, noise. Such parts or sub-units do not really need to be sound-insulated. In order to obtain access to such parts, either the complete hood is raised by a crane or the covering walls must be pushed back or reeled up to some extent.

Accordingly, it is an object of the invention to provide a weaving machine with a cover which covers only the noisiest parts of the machine.

It is another object of the invention to provide a cover of relatively simple construction.

It is another object of the invention to provide a cover for a weaving machine which can be easily manipulated to gain access to various components of the machine.

Briefly, the invention provides a weaving machine having a plurality of shafts for forming a shed of warp yarns disposed in a weaving plane, a reed, a sley for driving the reed and a breast beam with a protective sound-insulating cover which is disposed over the reed and the weaving plane and which extends from near the shafts towards the cloth end at most as far as the breast beam.

The cover serves not only for sound insulation but also for accident protection and the like. Basically, only the noisiest parts of the machine are covered. As a rule, considerable noise in weaving machines is evolved by the beating-up of the reed and by the reed-driving sley, the sley-driving elements, e.g. cams and cam followers, and by the reciprocation of the shafts with the heddles. The noise evolved by such items can be reduced by the cover particularly towards the cloth end, i.e. in the direction of the position of the operator who usually attends to weft breakages, other disturbances rising in connection with picking, warp breakages and so on from the cloth end of the machine.

The cover is very simple and can be readily folded in various ways when access is required to attend to faults occurring below the cover. The cover can also be readily fitted to existing machines without impairing the appearance of the machine. Unlike a cover provided for an entire whole machine, the cover ensures that the machine parts to which ready access is required and which contribute little, if at all, to the total noise, are not covered unnecessarily or in a manner causing a hindrance.

These and other objects and advantages of the invention will become more apparent from the following detailed description and appended claims taken in conjunction with the accompanying drawings in which:

Figure 3:
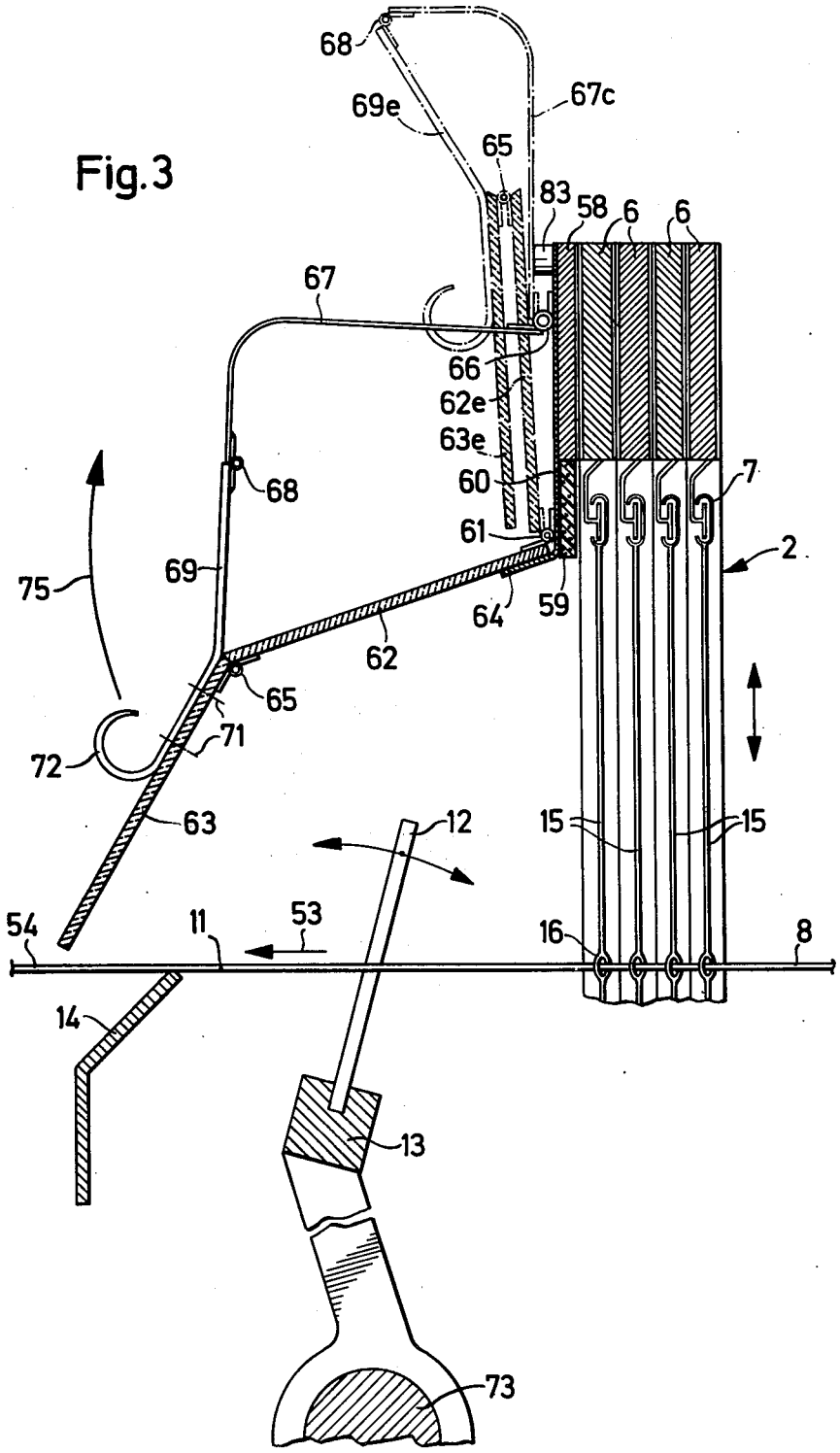
FIG. 3 illustrates a view to an enlarged scale and in section of a cover according to the invention.
Figure 3A:
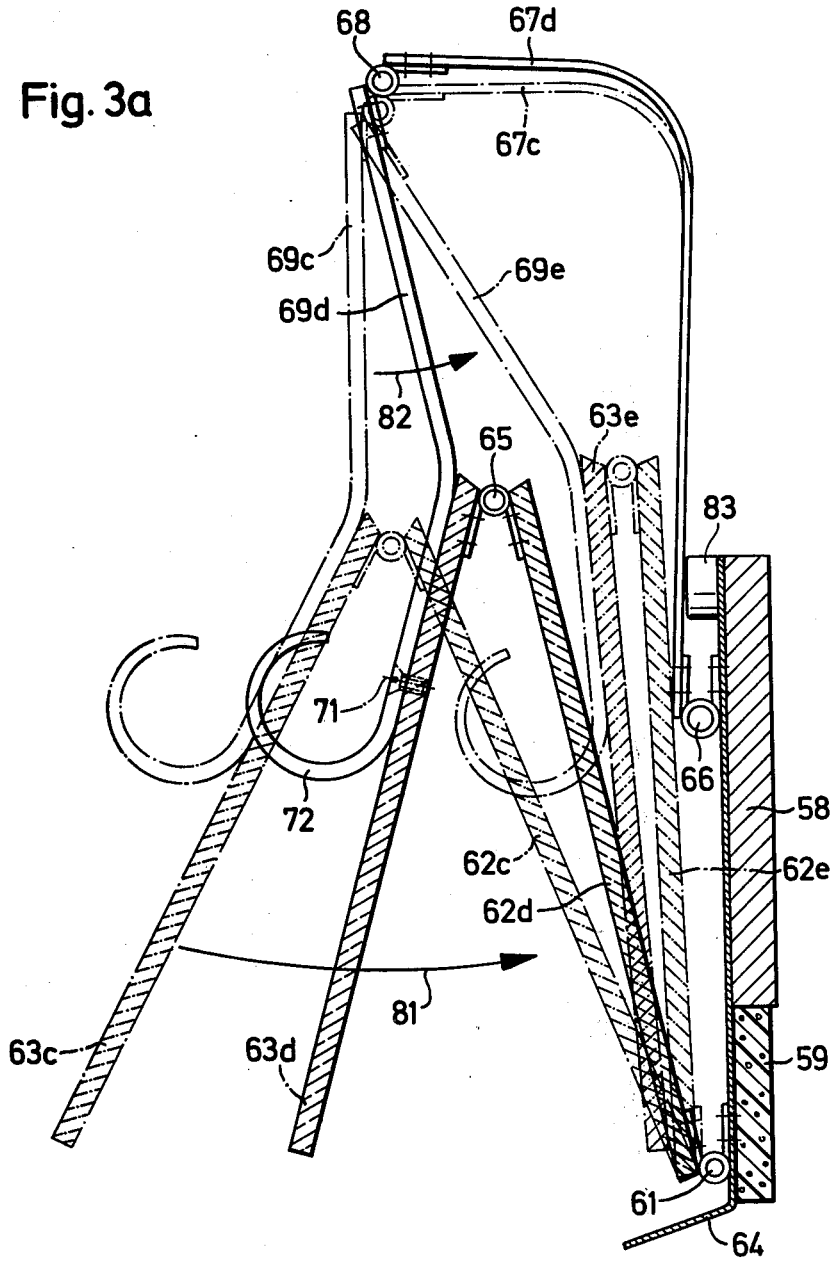
Figure 4:
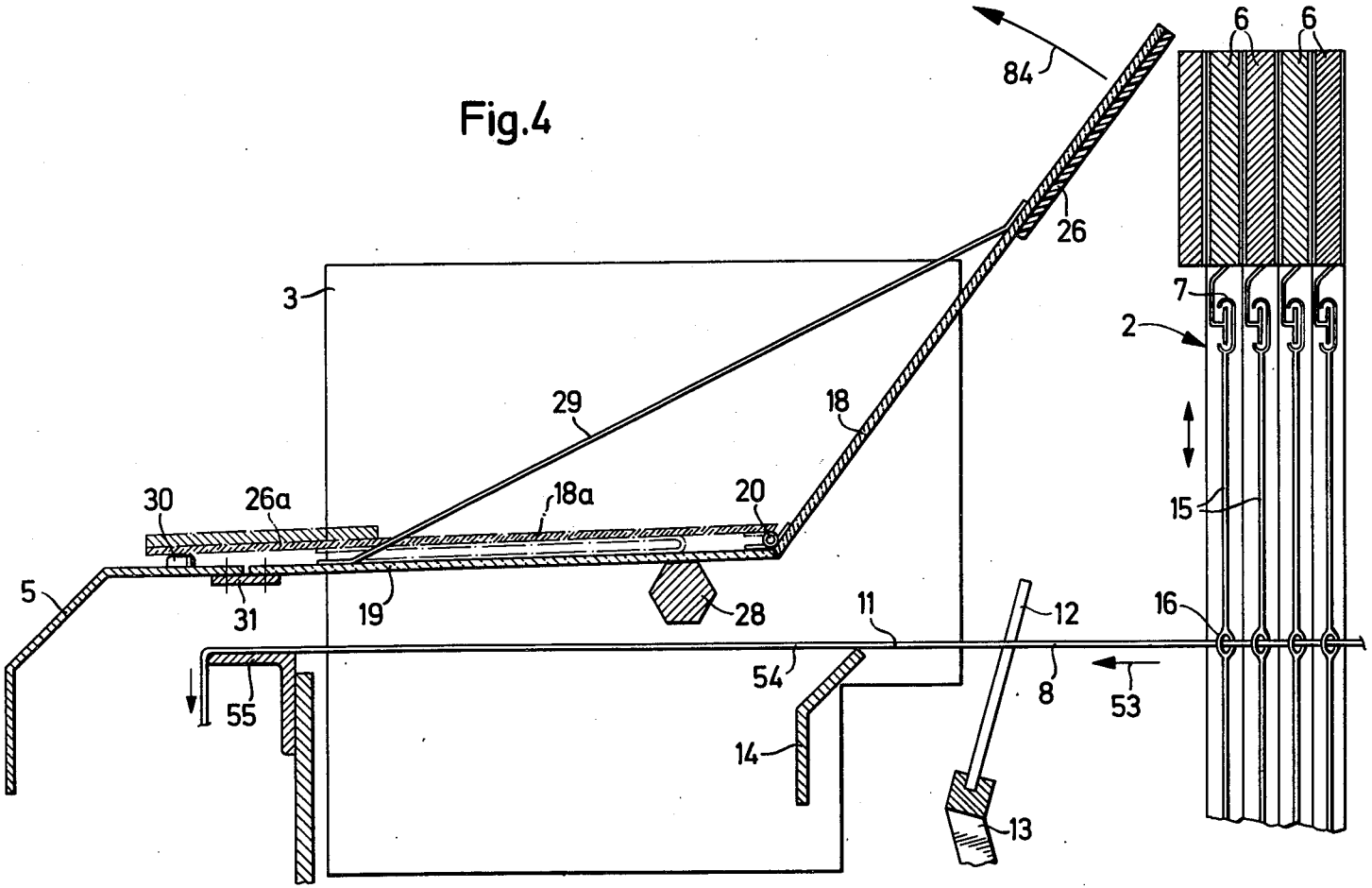
Figure 5:
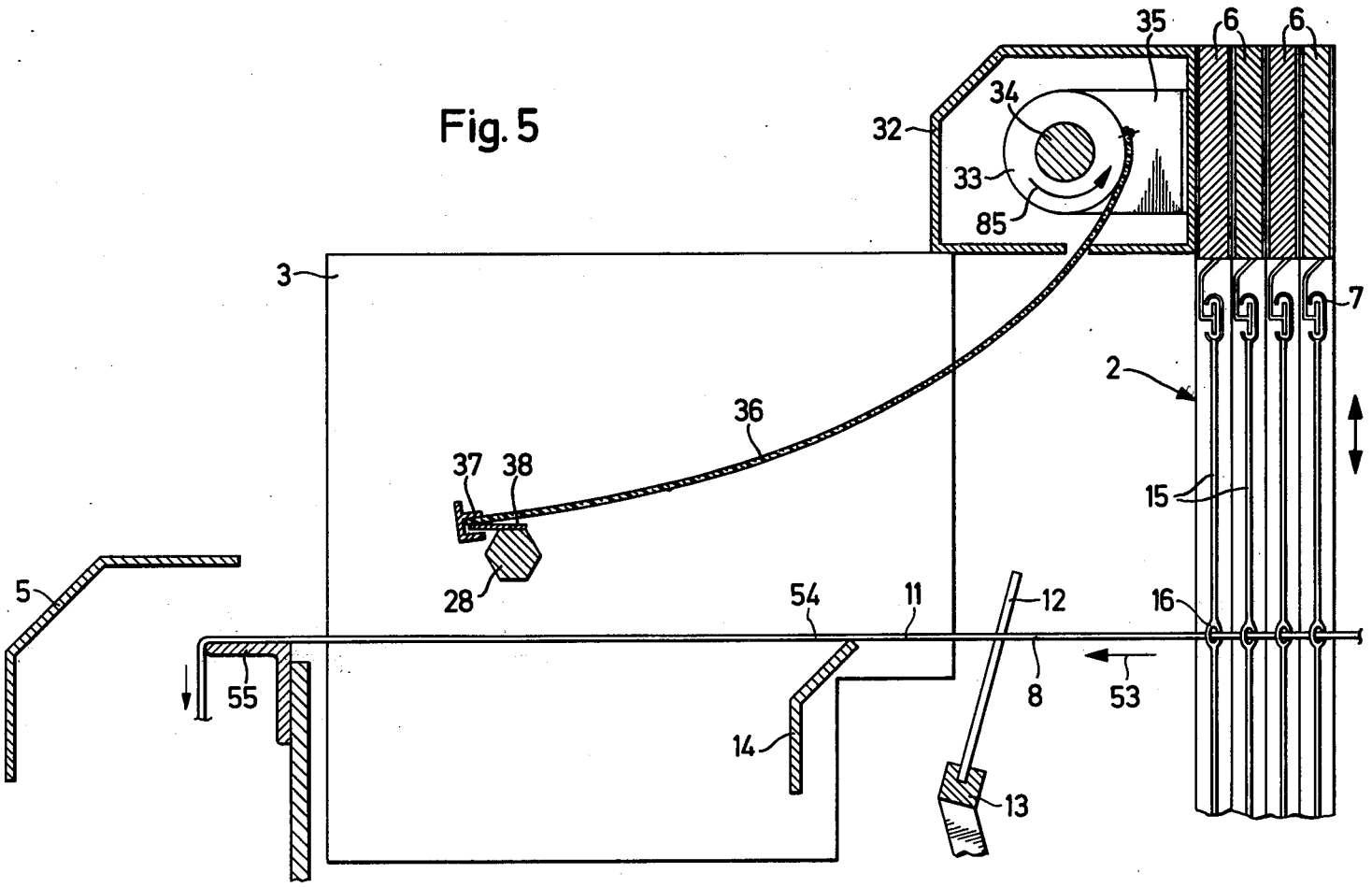
Figure 6:
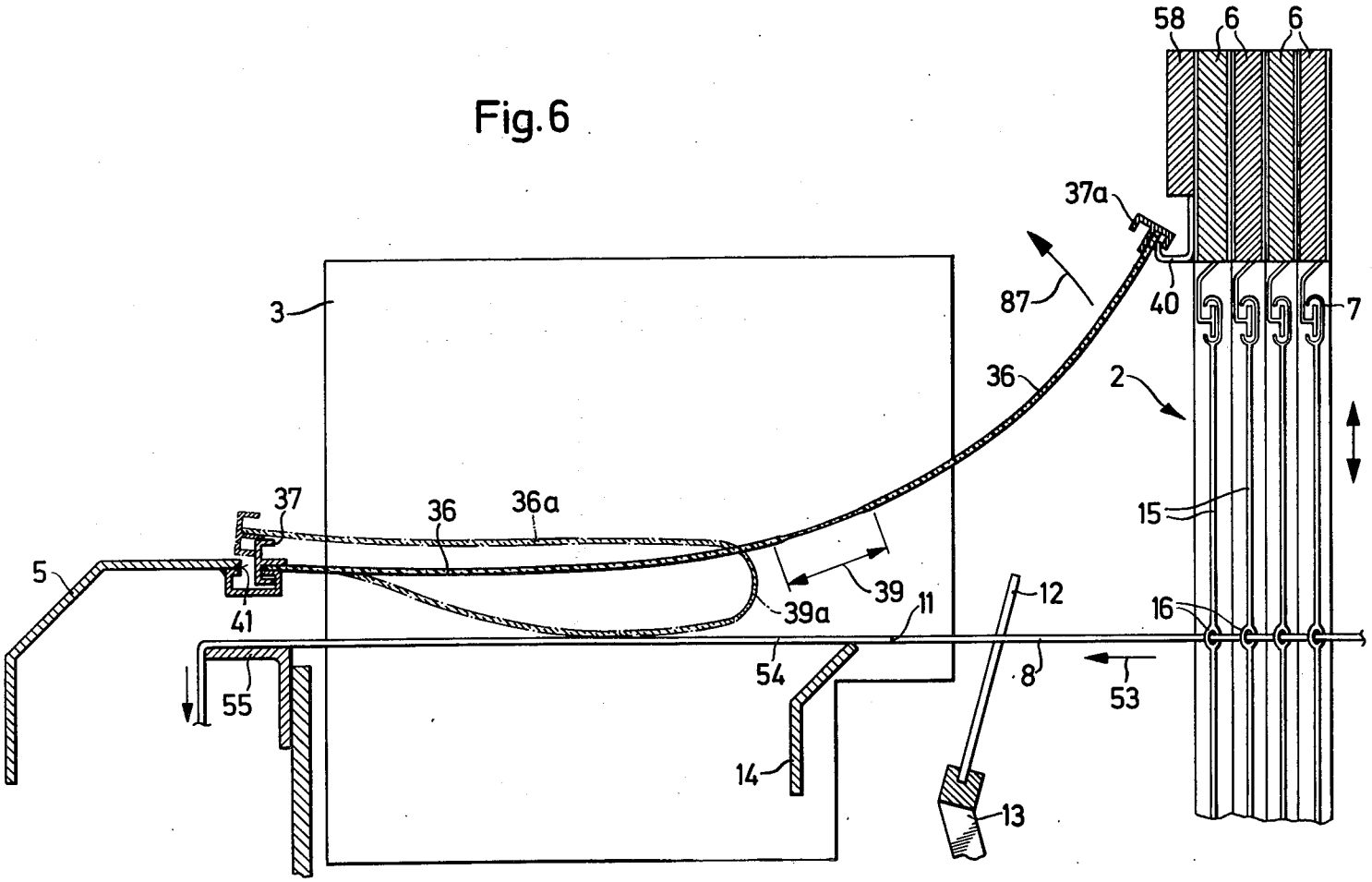

FIG. 3*a* illustrates the parts of the cover of FIG. 3 in various positions;

FIG. 4 illustrates a view of a modified cover according to the invention;

FIG. 5 illustrates a view of a further modified cover according to the invention of reelable form; and FIG. 6 illustrates a view of a further modified cover according to the invention.

Figure 1:
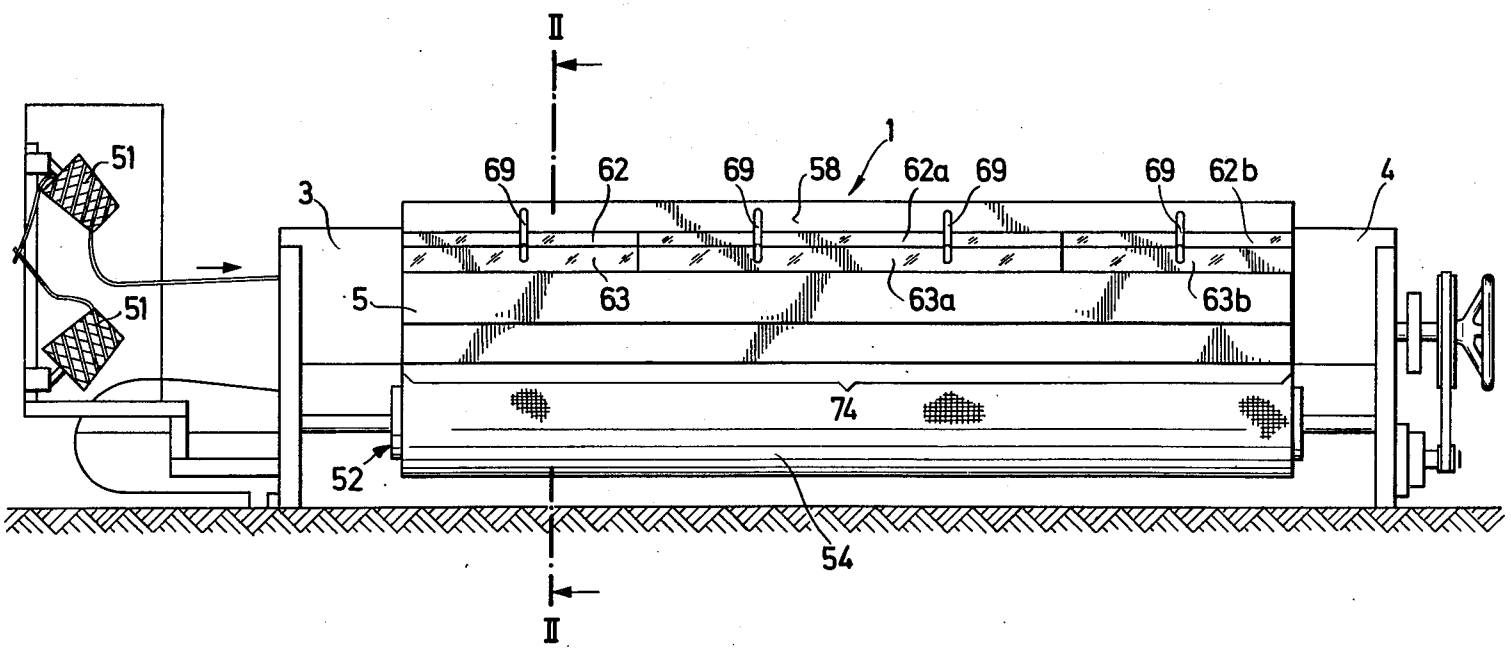
FIG. 1 illustrates a simplified view of a weaving machine according to the invention taken from the cloth end.
Figure 2:
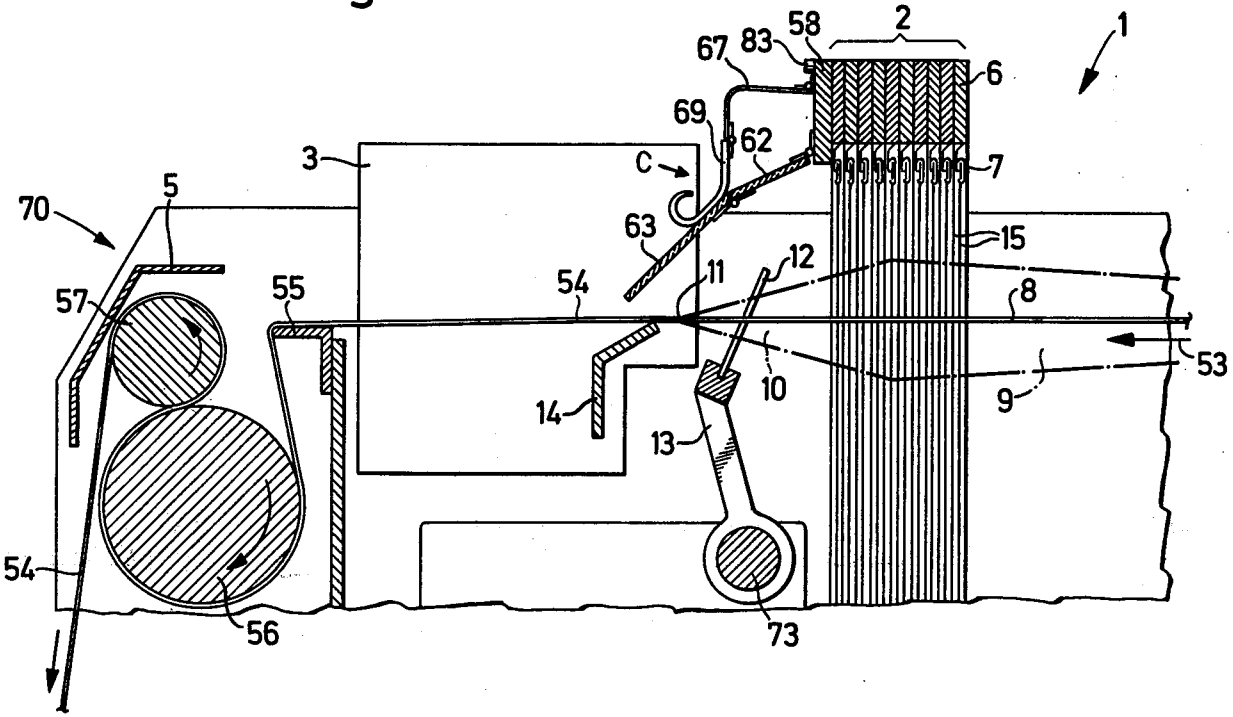
FIG. 2 illustrates a view taken on line II—II of FIG. 1.

Referring to FIGS. 1 and 2, the weaving machine 1 is of the gripper shuttle type which has shafts 2 for forming a shed of warp yarns 8 disposed in a weaving plane, a picking mechanism 3 for shooting the shuttles, a catcher 4, a breast plate 5, weft supply bobbins 51 and a cloth beam 52. In operation, the warp yarns 8 move in the direction indicated by an arrow 53 through eyes 16 (FIG. 3) of heddles 15 of the shafts 2 to form a back shed 9. The warp yarns 8 then form a front shed 10 and pass through a reed 12 driven by a sley 13 to a beating-up station 11. The cloth 54 which is formed then passes by way of a breast beam 55, cloth roller 56 and pressing roller 57 to a cloth beam 52.

The shafts 15 are shown in the closed shed position in FIGS. 2 and 3. In this position the warp yarns 8 are in the center plane (weaving plane of the machine).

The shafts 2 each include an elongated top beam 6 as is known for vertical movement to raise and lower the heddles 15. In addition, a fixed elongated carrier or support bar 58 is located adjacent to and parallel to the top beams 6 of the shafts 2 when the beams 6 are in a closed shed position. This carrier 58 has a plate 60 secured to the outside and a layer 59 of sound-absorbing material which is secured to the backside of the plate 60 below the carrier 58. This layer 59 serves to absorb sound transmitted by air and can be considered part of the sound protection.

A protective sound-insulating cover C is disposed over the reed 12 and the weaving plane and extends from near the shafts 2 towards the cloth end of the machine at most as far as the breast beam 55. This cover C comprises two plate-like folding members 62, 63 which are hingedly connected to each other via a hinge 65 with one member 62 being hingedly connected via a hinge 61 to the plate 60 on the carrier 58. The members 62, 63 are movable between a covering position i.e. a bottom position (FIG. 2) disposed in protective relation over at least the reed 12 and the shafts 2 and an open position (FIG. 4) spaced from the reed 12 to allow access to the reed 12 and shafts 2. The bottom position of the member 62 is determined by an angle-member 64 which forms an abutment for the member 62. This member 64 is formed by the bottom part of the plate 60.

In addition, the cover C includes an L-shaped rod 67 which is pivoted by way of a hinge 66 to the plate 60 on the carrier 58 and another rod 69 which is pivoted to the other end of the L-shaped rod 67 by way of another hinge 68. This latter rod 69 is secured by a screw 71 to the member 63 and has a portion forming a grip 72 for moving the cover C between the covering and open positions. The L-shaped rod 67 is of smaller cross-section than rod 69.

The members 62, 63 are transparent and can be made e.g. of plexiglass (PMMA - polymethylmethacrylate) to cover the weaving machine elements which are near the front shed 10 and which are very noisy, in particular the reed 12, sley 13 and their not completely shown drive members 73. Noise coming from the heddles 15 is greatly attenuated during travel to the cloth end 70 embodied by the parts 5, 55, 57, 56 which place is usually occupied by an operator clearing faults.

As shown in FIG. 1, the cover C is longitudinally divided into contiguous sections 62, 63; *62a, 63b; 62b, 63b* across the width 74 of the weaving machine.

If it is required, for instance, to clear a breakage of a warp yarn 8 somewhere near the reed 12 and the cloth support 14 and to release the warp yarn through an eye 16, the corresponding portion of the cover, e.g. the members 62, 63 can be lifted as indicated by an arrow 75. The members 62, 63 then move first into the position *62c, 63c, 69c, 67c* (FIG. *3a*). By action on the hand grip 72, the cover is pressed in the direction indicated by arrows 81, 82 through a dead-center position in which the parts temporarily take up the position *62d, 63d, 69d, 67d*. The L-shaped rod 67 then flexes at the top, which is possible because of its shape and its reduced cross-section. Upon further movement in the direction indicated by the arrows 81, 82, the parts finally reach the open position *62e, 63e, 69e, 67e*. In this position, the spring action of the rod 67 keeps the plate-like member 63 pressed against or in engagement with the plate-like member 62; the rod 67 being pressed against a stop or buffer or the like 83 on the carrier 58. With the cover in this position, the warp yarn breakage can be cleared and, although the parts are in the hinged-up open position, it is possible to look beyond the shaft 2 towards the rear shed 9.

The construction of the rods 67, 69 and the arrangement of the pivot points at 61, 65, 66, 68 are such that the members 62, 63 are guided positively when being hinged together or hinged apart. For hinging together, for instance, the member 63 can move only in a manner dependent upon the intermediate position of member 62 and member 63 cannot, for instance, knock accidentally against the moving reed 12. Nor is there any risk of the member 63 striking the moving shafts 2 during hinging apart.

Referring to FIG. 4, wherein like reference characters indicate like parts as above, the cover may alternatively be composed of two hinged members 18, 19 which are mounted on the breast plate 5. As shown, one member 19 is secured to the breast plate 5 by means of a connecting bar 31 and rests on a support 28 extending across the weaving machine frame (not shown). The members 18, 19 are so interconnected by a hinge 20 as to be hingeable together in the direction indicated by an arrow 84, so that member 18 moves into position *18a* and its sound-insulated end 26 moves into portion *26a* to contact a buffer or the like 30 on the breast plate 5. When in the solid-line operative position shown in FIG. 4, the member 18 is retained by a strut or the like 29. The members 18, 19 of FIG. 4 are made of Plexiglas and are transparent.

Referring to FIG. 5, wherein like reference characters indicate like parts as above, the cover 36 may be made of a flexible material and may be wound and unwound between the covering and open positions. To this end, a reel 33 which is rotatable around a spindle 34 is received in a casing 32 disposed at the height of the beams 6 when the beams 6 are in the closed-shed position shown and the cover 36 is secured to the reel 33 for selective winding and unwinding thereon.

The cover 36 is made from a flexible transparent PVC (polyvinyl chloride) foil adapted to be engaged with a support 28 by means of hooked parts 37, 38 respectively, on the cover 36 and the support 28. After disengagement from the hooked parts 37, 38, the foil can be wound on the reel 33 which can be rotated by means of a spring (not shown) in the direction indicated by an arrow 85.

Referring to FIG. 6, wherein like characters indicate like parts as above, the cover foil 36 may alternatively be removable from the machine. To this end, the bottom end of the cover 36 carries a hook 37 which is engaged in an aperture 41 in breast plate 5 while the top end carries a hook *37a* which is engaged in a hook 40 secured to the carrier 58. The cover 36 has an intermediate region 39 of reduced cross-section so that when the cover 36 has been disconnected at the top end and folded down in the direction indicated by arrow 87, the cover 36 can be placed in the chain-line position *36a*, a bend arising at a place *39a*.

The cover according to the invention has other uses, such as providing external protection for the reed 12 against being touched accidentally. Because of the flexible material of which the contiguous cover sections of FIG. 1 can be made, the sections can, if required, overlap, particularly in the case of the embodiment of FIG. 6.

In machines in which the weaving plane is substantially vertical, the cover according to the invention is disposed on that side of the weaving plane which is remote from the sley.

What is claimed is:

1. In combination with a weaving machine having a plurality of shafts for forming a shed of warp yarns disposed in a weaving plane, a reed, a sley for driving said reed and a breast beam at a cloth end;

a protective sound-insulating cover without side and rear walls disposed over said reed and said weaving plane and extending from near said shafts towards said cloth end at most as far as said breast beam, said cover being spaced from said shafts without covering said shafts.

2. The combination as set forth in claim 1 wherein said shafts each include an elongated beam and said weaving machine includes a fixed elongated carrier located adjacent and parallel to said beams with said beams in a closed shed position, said cover being secured to said carrier.

3. The combination as set forth in claim 2 wherein said cover includes at least two plate-like folding members hingedly connected to each other, one of said members being hingedly connected to said carrier, said members being movable between a covering position disposed in protective relation over at least said reed and said shafts and an open position spaced from said reed to allow access to said reed and said shafts.

4. The combination as set forth in claim 3 wherein said cover includes an L-shaped rod hingedly mounted on said carrier and a second rod secured to the other of said plate-like members and hingedly secured to said L-shaped rod, said second rod having a portion forming a grip for moving of said cover between said covering position and said open position, said L-shaped rod projecting beyond said members when said members are in said open position to bias said members into said open position.

5. The combination as set forth in claim 1 wherein said cover is made of flexible material.

6. The combination as set forth in claim 5 which further comprises a rotatable reel mounted on said weaving machine and secured to said cover for selectively winding and unwinding of said cover thereon.

7. The combination as set forth in claim 5 wherein said cover is foldable between a covering position disposed in protective relation over at least said reed and said shafts and an open position spaced from said reed to allow access to said reed and said shafts.

8. The combination as set forth in claim 1 wherein said cover is longitudinally divided into contiguous sections across said weaving machine.

9. The combination as set forth in claim 1 wherein said cover is made of transparent material.

* * * * *